United States Patent [19]

Paul

[11] 4,073,255

[45] Feb. 14, 1978

[54] DOCKING DEVICE

[76] Inventor: William A. Paul, 1808 Parkside Blvd., Toledo, Ohio 43607

[21] Appl. No.: 746,496

[22] Filed: Dec. 1, 1976

[51] Int. Cl.[2] ..... B63B 21/00

[52] U.S. Cl. ..... 114/230; 114/221 R

[58] Field of Search ..... 114/230, 221 R; 24/230.5; 294/20, 82 R; 29/235; 248/64, 63; 258/7

[56] References Cited

U.S. PATENT DOCUMENTS

| | | | |
|---|---|---|---|
| 977,158 | 11/1910 | Berkstresser | 294/20 |
| 2,845,892 | 8/1958 | Jorgenson | 114/230 |
| 2,912,953 | 11/1959 | Olsen | 114/230 |
| 2,931,853 | 4/1960 | Wilson | 24/230.5 |
| 2,938,492 | 5/1960 | Kuzick | 114/230 |
| 2,965,064 | 12/1960 | Wallace | 114/230 |
| 3,590,767 | 7/1971 | Dunbar | 114/230 |

FOREIGN PATENT DOCUMENTS

| | | | |
|---|---|---|---|
| 613,773 | 12/1948 | United Kingdom | 114/230 |

*Primary Examiner*—Trygve M. Blix

*Assistant Examiner*—Edward M. Wacyra

*Attorney, Agent, or Firm*—Allen D. Gutchess, Jr.

[57] ABSTRACT

A docking device is provided for aiding in the docking or mooring of a boat. The device is particularly advantageous for larger pleasure boats which may have but one pilot or operator but which normally require more than one person to dock the boat. The docking device includes a line held in an extended position by a mooring post on the side which the boat approaches. A line-engageable member is mounted on the boat and is positioned to engage the line as the boat approaches the docking area. In a preferred, form, the line-engageable member is a hook and is mounted so as to swung or extended outwardly from the boat in one position and to be retracted and out of the way in another position. The line is preferably releasably held relative to the post so that it will be partly released when engaged by the hook but will still be fastened to the dock or the post. Once the hook engages the line and the boat is stopped, the operator can then fasten additional mooring lines as desired.

10 Claims, 6 Drawing Figures

DOCKING DEVICE

This invention relates to a device for aiding in the mooring or docking of a boat.

Many boats can be difficult to dock, especially by one person, and especially under adverse conditions as where wind or waves are present. The operator frequently must leave the steering wheel or the outboard motor handle to be able to reach over to the dock or mooring post in order to secure a line thereto. In doing so, the operator also relinquishes control of the boat. As a consequence, the boat may drift or blow away from the dock before a tie-up can be made.

The present invention provides a docking device which enables an operator to secure a line from a dock or mooring post to the boat without having to leave the controls of the boat. The docking device includes a mooring line which is releasably held in an extended position by a post or the like on the side from which the boat approaches. A suitable resilient arm can be employed for this purpose. A line-engageable member, preferably in the form of a hook, is mounted on the boat and engages the line as the boat approaches the dock. A temporary connection is thereby achieved between the dock and the boat with the operator then typing up additional mooring lines if desired. The line is preferably releasably held by the resilient arm to prevent abrupt stopping of the boat when the line is engaged. Further, the line-engageable hook preferably is mounted on the boat in a manner such that it can extend from the boat, as the boat approaches the dock, but otherwise is held in a retracted, out of the way position.

It is, therefore, a principal object of the invention to provide apparatus for facilitating the docking of a boat, particularly by one operator.

Many other objects and advantages of the invention will be apparent from the following detailed description of a preferred embodiment thereof, reference being made to the accompanying drawings, in which.

Figure 1:
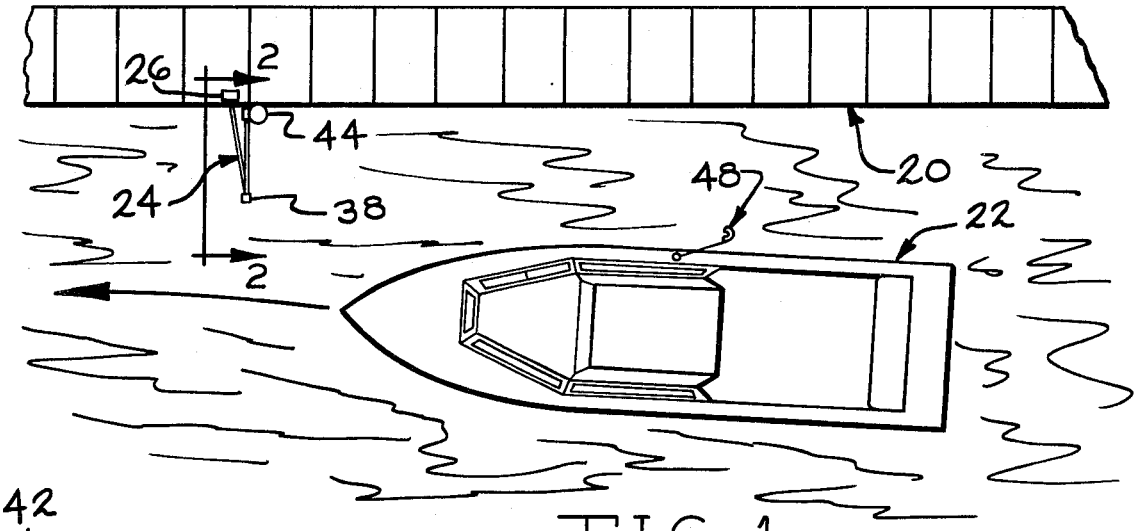
FIG. 1 is a schematic plan view of a boat and a dock having a docking device embodying the invention.
Figure 2:
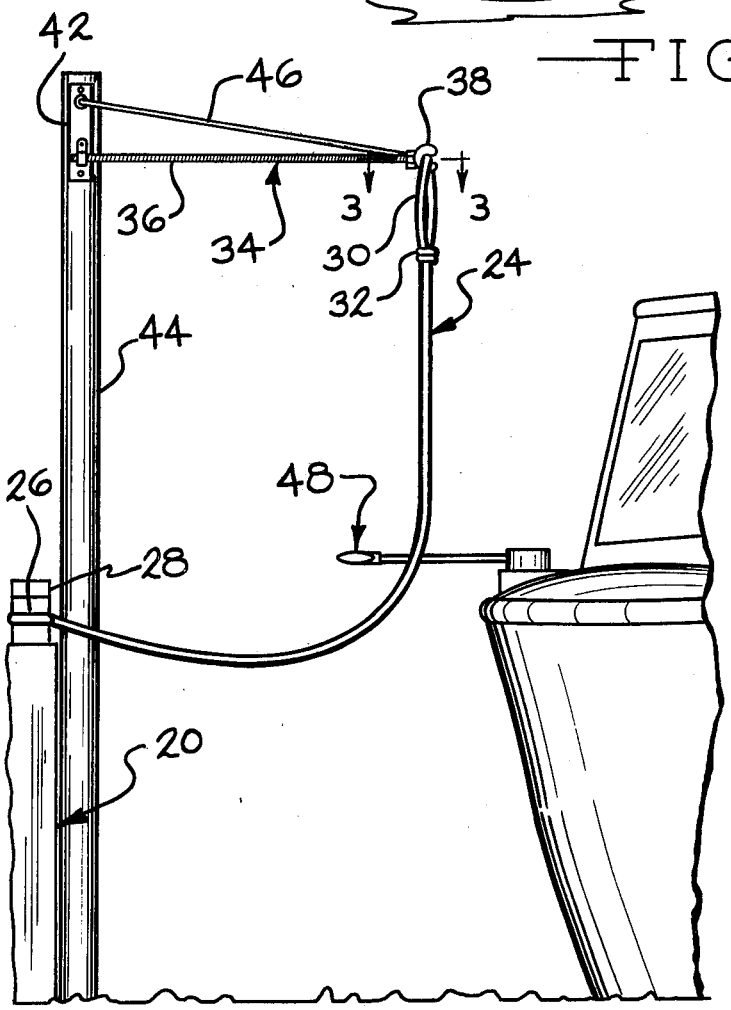
FIG. 2 is a view in elevation taken along the line 2—2 of FIG. 1.

Referring to the drawings, and particularly to FIG. 1, a stationary dock or the like is indicated at 20 and is being approached by a boat indicated at 22. The boat may have only one operator or pilot and is of a size such that it is difficult to dock, particularly by only one person, and especially under adverse conditions, such as strong winds or high waves being present.

Figure 3:
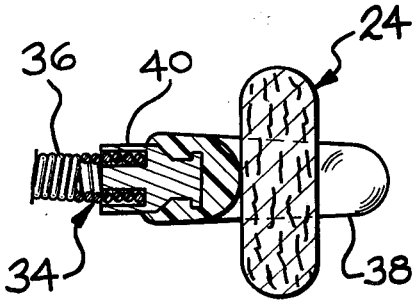
FIG. 3 is an enlarged, fragmentary, detailed view taken along the line 3—3 of FIG. 2.

A docking device according to the invention includes a mooring line 24 having an end 26 affixed to an anchor member or cleat 28 on the dock 20 with the other end of the line 24 having a loop 30, at the end of which is formed a knot or enlargement 32. A portion of the line 24 spaced from the loop 30, and preferably an intermediate portion of the line between the loop and the anchored end 26, is held in a suspended condition by a suspension device 34, which engages the loop 30. The device 34, in this instance, includes a resilient arm 36, which can be in the form of a coil spring, having resilient fingers 38 formed at the outer end thereof. As shown in FIG. 3, the resilient fingers 38 are of rubber and have a connection 40 molded therein which receives an end of the arm 36. The inner end of the arm 34 is connected to a bracket 42 which is fastened to a mooring post 44 or other anchoring means associated with the dock 20. Since the arm 36 is highly flexible, to even avoid damaging a boat hitting it directly on the end, a wire 46 is connected to the fingers 38 and suspends the arm, the inner end of the wire being affixed to an upper portion of the bracket 42. This enables the arm 36 to support the weight of the mooring line 24 and yet still be highly flexible.

Figure 4:
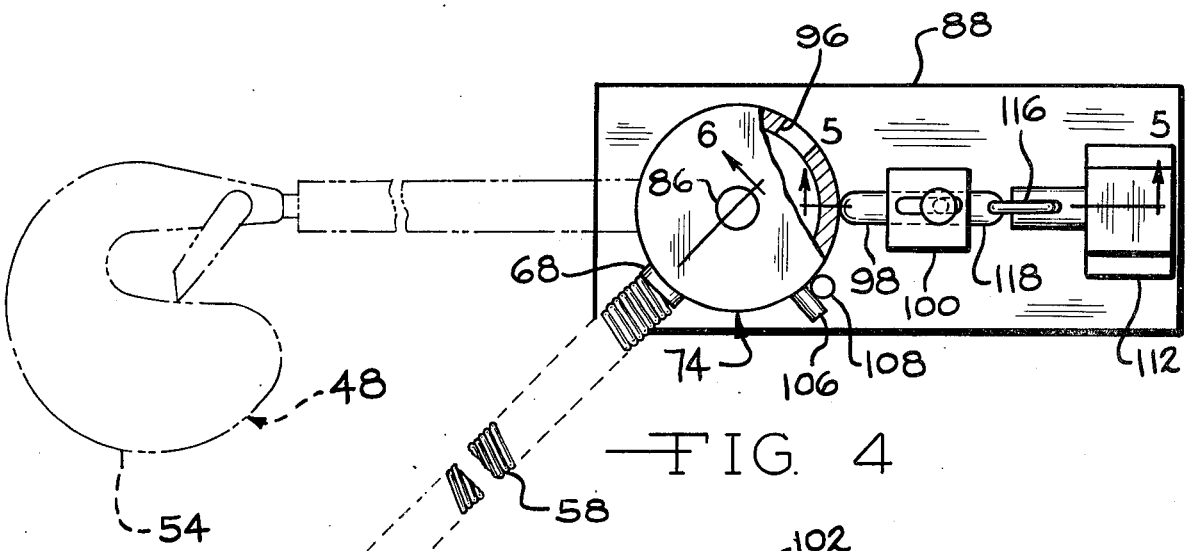
FIG. 4 is a fragmentary, plan view of a part of the docking device mounted on the boat.
Figure 5:
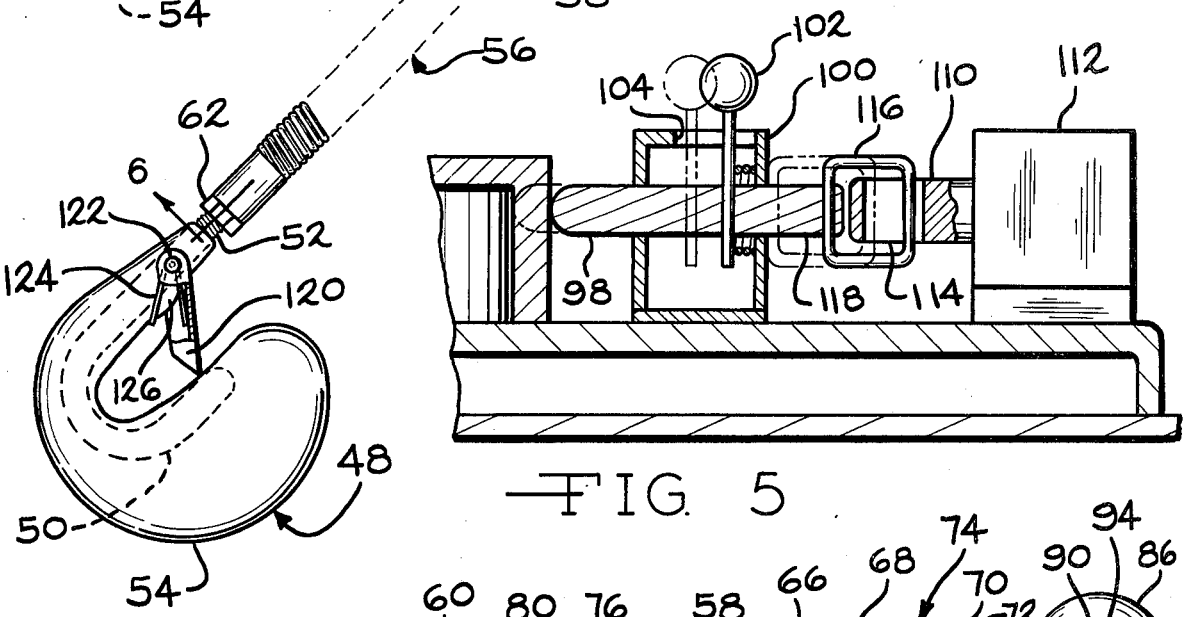
FIG. 5 is a fragmentary view in cross section taken along the line 5—5 of FIG. 4.
Figure 6:
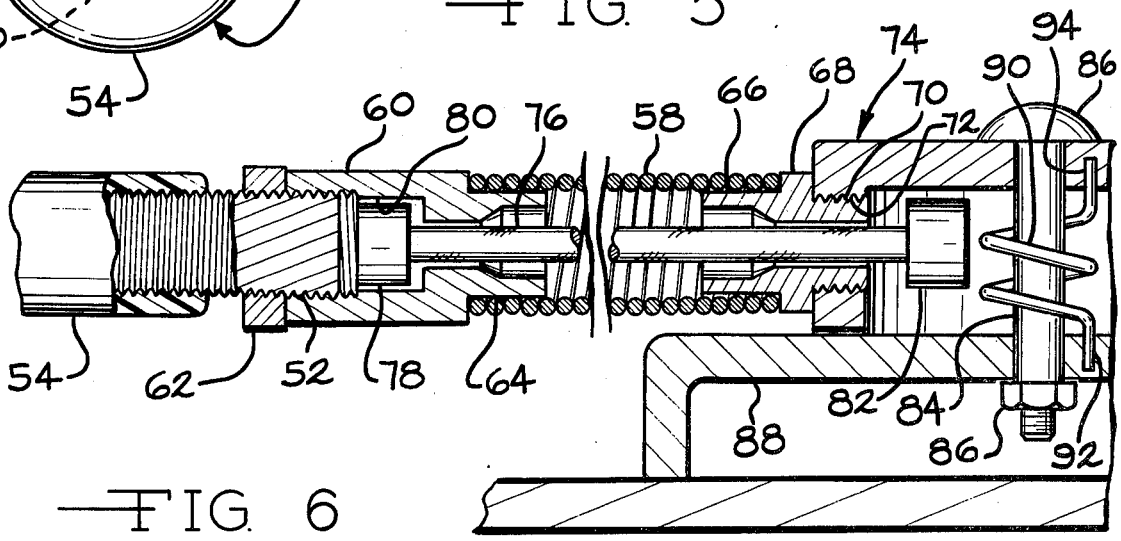
FIG. 6 is a fragmentary view in transverse cross section taken along the line 6—6 of FIG. 4.

The docking device also includes a line-engageable member associated with the boat 22 for engaging the suspended line 24 when approaching the dock. Referring to FIGS. 4–6, a line-engageable member is shown as a hook 48 and specifically includes a rigid hook core 50 terminating in a threaded end 52, with a large bulbous covering 54 on the hook core 50, and extending outwardly beyond the free end thereof. This particular design of the hock 48 with the large bulbous cover 54 prevents the hook from accidentally catching on such protuberances as the mooring post 44. Rather, the hook will simply bounce off such protuberances without catching and causing damage to the protuberances or the boat.

The hook 48 is mounted on a resilient arm 56 which includes a coiled spring 58 of sufficient ridigity to support the hook 48 in a position extending horizontally from the boat. The threaded end 52 of the hook core 50 is turned into an outer fitting 60 and held in the horizontal position by a jam nut 62. The fitting 60 has a necked-down portion 64 which is received in the spring 58 and held by any suitable means such as by brazing. The opposite end of the spring 58 fits over a neck 66 of an inner fitting 68 having a threaded end 70 turned into a tapped opening 72 of a housing 74. A small elongate member or cable 76 which is strong in tension extends completely through the spring 58 and constitutes part of the arm 56. The outer end of the cable has an enlargement 78 received in a recess 80 of the fitting 62 while the inner end of the cable has an enlargement 82 located within the housing 74 slightly beyond the threaded end 70 of the fitting 68. This extra length of the cable 76 enables the spring 58 to bend which could not readily occur if the cable were tightly connected at the ends to the fittings 60 and 68. The arm 56 thus has resiliency and yet is strong in tension due to the cable 76.

The housing 74 has a central post or shoulder bolt 84 having an upper head 86 and a lower end receiving a nut 86 below a mounting plate 88. The post 84 has a shoulder at the lower threaded end to limit the extent to which the nut 86 can be turned thereon. This enables the housing 74 to be pivotally movable on the mounting plate 88. A torsion spring 90 is located around the post 84 and is affixed in the plate 88 at a lower end 92 and is affixed to the housing 74 at an upper end 94. As viewed in FIG. 4, the torsion spring 90 urges the housing 74 in a counterclockwise direction.

The housing 74 has an opening or recess 96 in the side which can receive a pin 98 to hold the hook 48 in an out-of-the-way or retracted position so as not to extend beyond the side of the boat. The pin 98 is mounted in a guide 100 for slidable movement relative thereto. As shown in FIG. 5, the pin has a releasing knob 102 extending upwardly therefrom through a slot 104 in the guide 100. The knob can be pulled back manually to release the pin 98 from the recess 96. The torsion spring 90 then causes the housing 74 to pivot in a counterclockwise direction until an extension stop 106 extending from the housing hits a stop pin 108 mounted on the plate 88.

If desired, the pin 98 can be remotely released by an armature 110 of a solenoid 112. The armature 110 has a slot 114 through which a link 116 connects the armature to a rear portion 118 of the pin 98. The slot 114 enables the pin 98 to be retracted manually even when the armature 110 of the solenoid is in its forward, deenergized position, as shown in FIGS. 4 and 5. When the solenoid 112 is energized, it retracts the armature 110 and releases the pin 98 from the recess 96 to enable the hook 48 to swing to its outer, engageable position. The solenoid can be energized by a switch located at the operator's controls so that he can render the hook operative without leaving the controls of the boat.

When the hook 48 is in its engageable position and engages the mooring line 24, the suspended portion of the line is received by the hook and is held by a releasable catch 120 which is pivotally mounted on the hook core 50 by a pin 122 and is urged to the blocking position of FIG. 5 by a torsion spring 124. This is a light spring which enables the catch to be readily deflected when engaged by the mooring line, with the catch then returning to the outer position to hold the line securely in the hook. The catch 120 is certain to be deflected when the loop 30 is stripped from the fingers 38, if not before. The suspended portion of the line then slides through the hook until the hook engages the knot 32. The boat then stops when the line 24 becomes taut between the anchor member 28 and the hook 48 with the spring 58 being stretched slightly until the cable 76 is under tension. The covering 54, which can be of rubber or a resilient plastic, can have a bulbous portion 126 which must be depressed by the cathc 120 to release the line. This provides additional resistance to the release of the line and helps to assure that the line will not slip out of the hook. The pilot or operator can then place the looped portion 30 of the line 24 around a cleat on the boat, if desired, and can tie up other mooring lines from the boat to the dock.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Apparatus for aiding in docking a boat to a stationary dock member or the like, said apparatus comprising, in combination, a line-engageable member, means for mounting said line-engageable member on a boat for movement between an extended position extending beyond the side of the boat and a retracted position in which the member does not extend beyond the side of the boat, said mounting means including a flexible arm connected to said line-engageable member and being in a generally horizontal position when said line-engageable member is in the extended position, and a mooring line to be held by a stationary dock member and positioned such as to be engaged by said line-engageable member when the line is intercepted thereby.

2. Apparatus according to claim 1 characterized by said flexible arm including an elongate member which is strong in tension connected to said line-engageable member and connectable to the boat.

3. Apparatus according to claim 1 characterized by said mounting means including means for urging said line-engageable member from the retracted position to the extended position, and electrically-operated, releasable catch means for holding said line-engageable member in the retracted position and capable of being operated from a remote position.

4. Apparatus for aiding in docking a boat to a stationary dock member or the like, said apparatus comprising, in combination, a boat having a line-engageable member extendible therefrom to one side thereof, a resilient arm mounted on the dock member, releasable fingers on an outer end of said arm, and a flexible line having one portion releasably held by said releasable fingers to be engaged by said line-engageable member as the boat approaches the dock member.

5. Apparatus according to claim 4 characterized by said resilient arm being a coiled spring.

6. Apparatus according to claim 4 characterized by a flexible arm connected to said line-engageable member to hold said line-engageable member in the extendible position.

7. Apparatus for aiding in docking a boat to a stationary dock member or the like, said apparatus comprising, in combination, a line-engageable member, means for mounting said line-engageable member on the boat in at least one extended, line-engageable position, said mounting means including a flexible arm connected to said line-engageable member and extending generally horizontally and angularly from the side of the boat when said line-engageable member is in the extended position, a flexible line, and resilient fingers attachable to the dock member for releasably holding a portion of said flexible line and for releasing said line when said line is engaged by said line-engageable member.

8. Apparatus according to claim 7 characterized by and end portion of said flexible line being carried by said resilient fingers and the other end of said line being attachable to a portion of said dock member.

9. Apparatus according to claim 7 characterized by said flexible line having a portion affixed to a stationary dock member and having an enlargement at a portion spaced from the affixed portion to be engaged and held by said line-engageable member.

10. Apparatus according to claim 9 characterized by said line further having a loop on the side of said enlargement opposite said affixed portion.

* * * * *